US007909149B2

(12) United States Patent
Marji

(10) Patent No.: US 7,909,149 B2
(45) Date of Patent: Mar. 22, 2011

(54) LUGGAGE SYSTEM FOR SIMULTANEOUS TRANSPORTING OF ATTACHED LUGGAGE PIECES

(76) Inventor: Ghassan Marji, Yonkers, NY (US)

( * ) Notice: Subject to any disclaimer, the term of this patent is extended or adjusted under 35 U.S.C. 154(b) by 142 days.

(21) Appl. No.: 12/283,127

(22) Filed: Sep. 10, 2008

(65) Prior Publication Data

US 2010/0059323 A1 Mar. 11, 2010

(51) Int. Cl.
*A45C 3/00* (2006.01)

(52) U.S. Cl. ..... 190/18 A; 190/18 R; 190/111; 190/126

(58) Field of Classification Search ..... 190/18 A, 190/18 R, 111, 126; 280/478.1, 479.2, 479.3
See application file for complete search history.

(56) References Cited

U.S. PATENT DOCUMENTS

| | | | | | |
|---|---|---|---|---|---|
| 1,084,360 | A * | 1/1914 | Rahm | 190/108 |
| 4,114,234 | A * | 9/1978 | Hogenson | 16/411 |
| 4,474,282 | A * | 10/1984 | Lenander | 194/247 |
| 4,573,564 | A * | 3/1986 | Rheeder et al. | 194/250 |
| 4,589,538 | A * | 5/1986 | Payraudeau | 194/205 |
| 4,759,431 | A * | 7/1988 | King et al. | 190/18 A |
| 4,813,542 | A * | 3/1989 | Thompson et al. | 206/504 |
| 4,836,343 | A * | 6/1989 | Arney | 190/108 |
| 4,966,260 | A * | 10/1990 | Young | 190/111 |
| 5,050,713 | A * | 9/1991 | Lee | 190/108 |
| 5,099,968 | A * | 3/1992 | Kikuchi | 190/108 |
| 5,722,678 | A * | 3/1998 | Hunger | 280/478.1 |
| 5,727,805 | A * | 3/1998 | La Roque | 280/478.1 |
| 6,547,113 | B1 * | 4/2003 | Hancock et al. | 224/408 |

* cited by examiner

*Primary Examiner* — Anthony Stashick
*Assistant Examiner* — Cynthia F Collado

(57) ABSTRACT

A luggage system is provided for simultaneous transportation of attached suitcases. Two side-by-side suitcases are secured together by providing a male connector on a side of a first suitcase and a female connector on the side of a second suitcase which faces the side of the first suitcase. The male connector and female connector inter-engage to secure the two suitcases and prevent them from displacement or disengagement during transportation.

2 Claims, 3 Drawing Sheets

LUGGAGE SYSTEM FOR SIMULTANEOUS TRANSPORTING OF ATTACHED LUGGAGE PIECES

FIELD OF THE INVENTION

This invention relates generally to transporting of luggage pieces and is particularly related to a luggage system for simultaneous transporting of attached luggage pieces which are secured to each other during their transportation.

BACKGROUND OF THE INVENTION

Travelers often need to carry more than one piece of luggage during their travel and it is a matter of common experience that carrying large and heavy suitcases can be extremely difficult and strenuous. The development of wheeled luggage has, to an extent, eased the transportation of heavy luggage and systems have been developed for piggybacking of luggage to facilitate the carrying of more than one piece of luggage. Several prior art patents have disclosed systems for piggybacking or side attachments of suitcases in order to facilitate the carrying of more than one piece of luggage. See, e.g., U.S. Pat. No. 4,759,431 issued to William L. King and Daniel G. Elles on Jul. 26, 1988; U.S. Pat. No. 5,593,609 issued to William L. King on Jan. 14, 1997; and U.S. Pat. No. 5,762,169 issued to Laurence J. Deliman et al. on Jun. 9, 1998.

Piggybacking suitcases frequently cause one or the other suitcase to be displaced even when they are strapped. Side-by-side carrying of two or more luggage can also result in displacement or separation between the luggages. Both of these systems are inconvenient and often require reassembling and securely strapping the luggages.

Accordingly, it is an object of this invention to provide a luggage system which assures securing the luggages so as to prevent their displacement or separation during their transportation.

It is also an object of this invention to provide a luggage system which facilitates simultaneous transportation of more than one piece of luggage regardless of size and with minimal or no possibility of displacement or separation during their transportation.

The foregoing and other advantageous features of this invention will become evident from the following detailed description of the invention and the accompanying drawings.

SUMMARY OF THE INVENTION

In accordance with this invention, a luggage system is provided consisting of two suitcases which can be secured to one another and can be conveniently transported without displacement of the luggage. This system contemplates using two side-by-side suitcases wherein a side of one suitcase faces an opposed side of the other suitcase. A male connector is hingedly connected to a side of one suitcase and a female connector is hingedly connected to the opposed side of the other suitcase. The male connector has a laterally extending male member and the female connector has a laterally extending channel defining the female member, on the same horizontal plane as the male member. The male member is adapted to be engaged, such as frictionally into the female member and is secured therein. A vertically disposed pin vertically extending through the female member prevents displacement of the male member and assures interlocking engagement of the male connector into the female connector.

BRIEF DESCRIPTION OF THE DRAWINGS

In the drawings, wherein like reference numerals designate like parts.

DETAILED DESCRIPTION OF THE INVENTION

Figure 1:
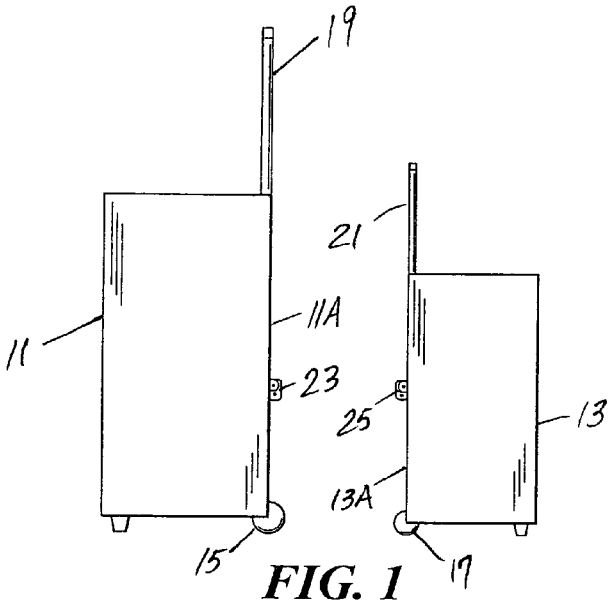
FIG. 1 is a side view of two suitcases side-by-side, with connectors provided at facing sides of each suitcase, the connectors being in folded down mode.
Figure 2:
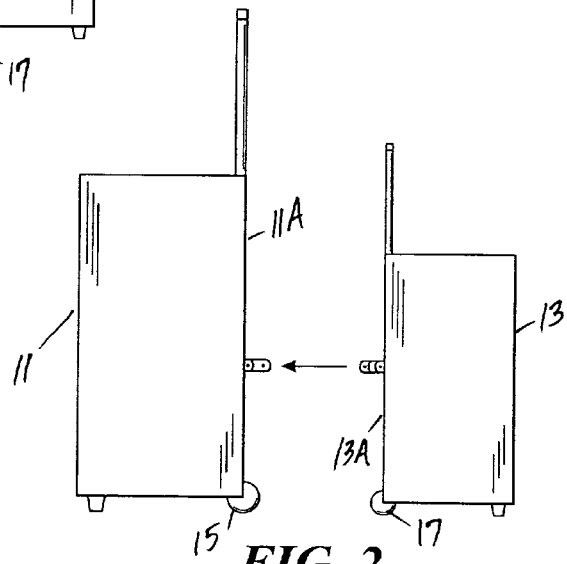
FIG. 2 is a view similar to FIG. 1 with the connectors in connecting position.
Figure 3:
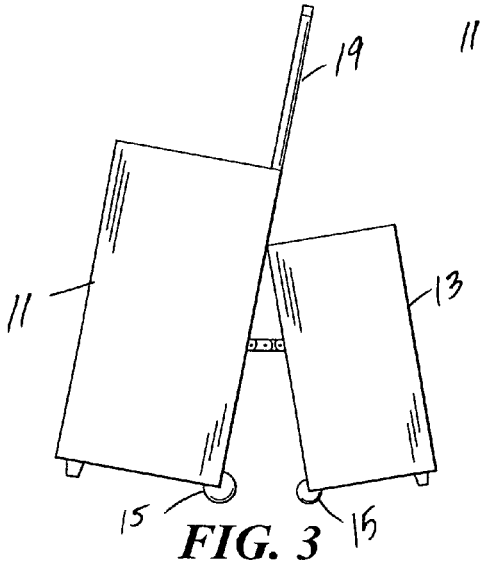
FIG. 3 is a side view of two suitcases as in FIGS. 1 and 2 with the connectors engaged to one another.

Referring to the drawings and first to the embodiment illustrated by FIGS. 1-5, there is shown in FIG. 1 two wheeled suitcases 11 and 13 each having roller wheels 15 and 17 and provided with pull handles 19 and 21. Although one suitcase is shown smaller than the other, the two suitcases may be equal or different in size and each handle may be of the collapsible type. Each of the face sides 11A and 13A of the two suitcases 11 and 13 is provided with a connector such as the male connector 23 and the female connector 25 which face opposite each other and are adapted to inter-engage as hereinafter explained.

Figure 4:
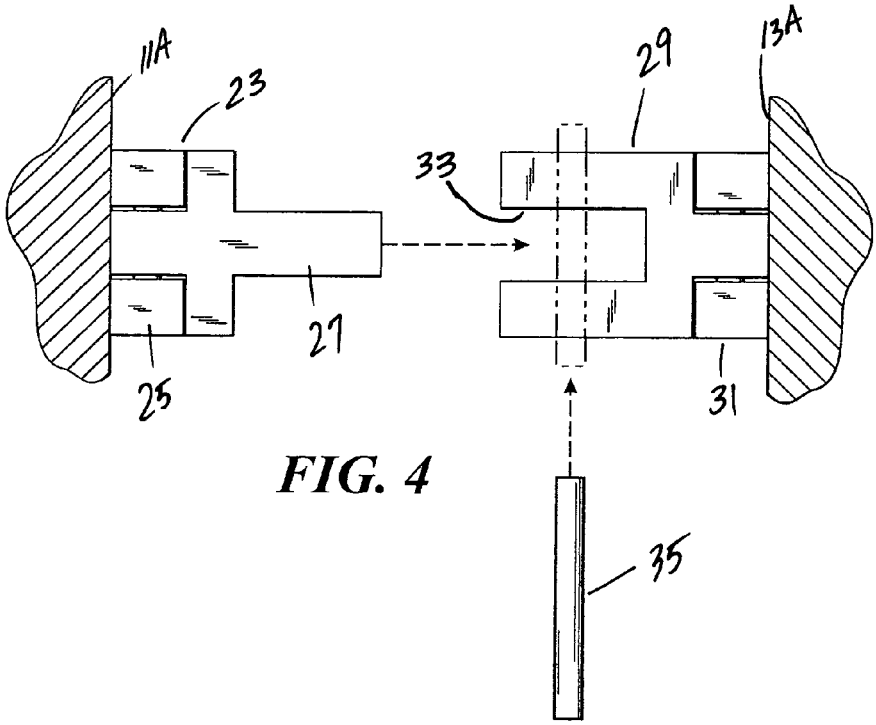
FIG. 4 is a view of the facing sides of each luggage with attached female and male connectors.
Figure 5:
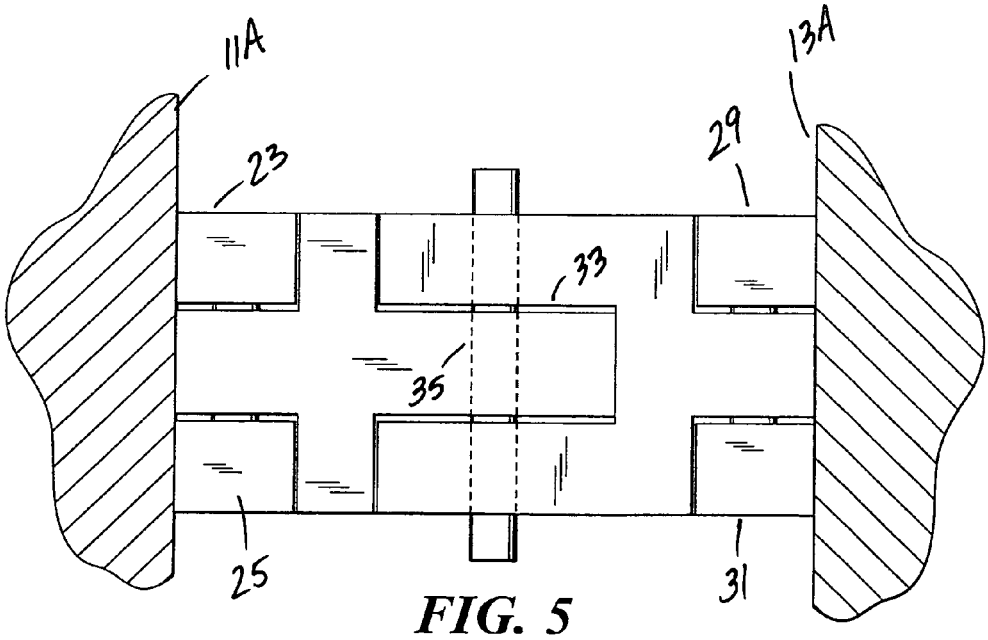
FIG. 5 is a view similar to FIG. 4 with the male and female connectors shown in interlocking position.

FIG. 4 shows the male connector 23 hingedly connected to the side wall 11A as at 25, having a laterally extending male member 27, and a female connector 29 hingedly connected to the side wall 13A as at 31, having a laterally extending channel 33 which defines the female portion of the female connector 29. The male member 27 and the channel 33 are sized so that in order to attach the suitcases 11 and 13, the male member 27 is engaged into the channel 33 and is secured therein against displacement by the pin 35 which serves to prevent reverse displacement of the male member. See FIG. 5. The aforementioned arrangement and its description indicate the means of attachment of two suitcases which can be transported with ease by pulling the handle 19 without displacement of the luggage.

Alternatively, the male member 27 may be externally threaded and the channel 33 may be internally threaded for threaded engagement of the male member 27 into the female member (channel 33).

Figure 6:
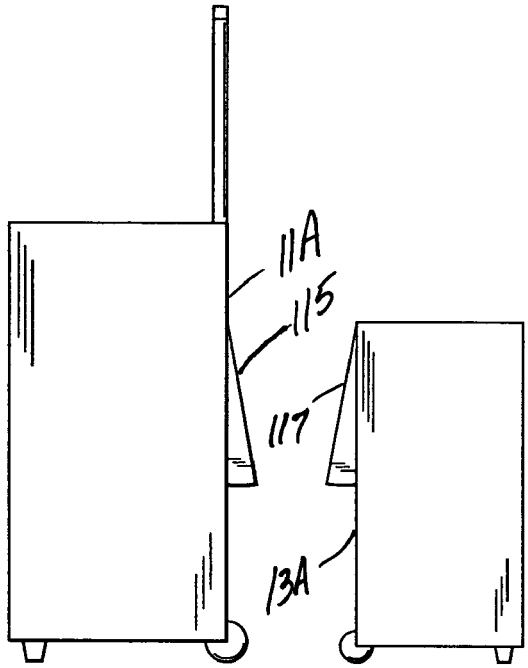
FIG. 6 is a side view of two suitcases as in FIG. 1 wherein each of the facing sides of the two suitcases is provided with a magnet adapted to be magnetically engaged to one another, according to another embodiment of the invention.
Figure 7:
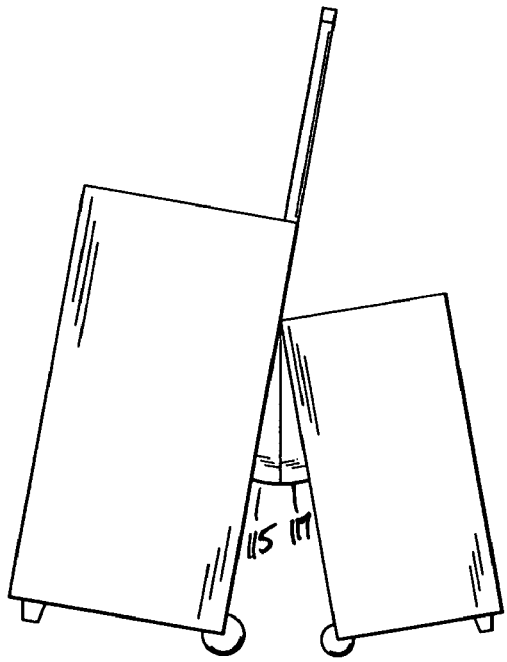
FIG. 7 is a view similar to FIG. 6 with the magnets attached to one another.

FIGS. 6 and 7 illustrate another embodiment of the invention in which the side face 11A of suitcase 11 and side face 13A of suitcase 13 is each provided with a magnet such as the magnets 115 and 117 so that when the two suitcases are attached side-by-side, the magnetic surface of each magnet are magnetically attached to each other thus securing the two suitcases for transporting by pulling the handle 19.

From the foregoing description other changes and modifications are suggested which are obvious to one skilled in the art. For example, the male and female members may be threaded to facilitate threaded engagement of the male member with the female member. Also, more than two suitcases may be attached by providing opposed, i.e., facing sides of each suitcase with a connector as herein described. Also, the male connector and female connector may be made of metallic or a suitable plastic material.

The invention claimed is:

1. A luggage system for simultaneous transportation of attached suitcases comprising:

two side-by-side suitcases, a first suitcase and a second suitcase, said first suitcase having a side facing a side of said second suitcase, A male connector comprising a hinged portion hingedly attached to said side of said first suitcase, and a laterally extending member, and a female receptor having a hinged portion hingedly attached to said side of said second suitcase, a lateral channel adapted to inter-engage with said hingedly extending member of said male connector, and a vertically disposed pin through said channel for preventing said male member from disengagement from the female member.

2. A luggage system as in claim 1 wherein said male member is frictionally engaged into said channel.

* * * * *